US010993542B2

(12) United States Patent
Meisner

(10) Patent No.: US 10,993,542 B2
(45) Date of Patent: May 4, 2021

(54) BED MOUNTED EXERCISE SYSTEM

(71) Applicant: Russell Meisner, Poulsbo, WA (US)

(72) Inventor: Russell Meisner, Poulsbo, WA (US)

( * ) Notice: Subject to any disclaimer, the term of this patent is extended or adjusted under 35 U.S.C. 154(b) by 209 days.

(21) Appl. No.: 15/873,157

(22) Filed: Jan. 17, 2018

(65) Prior Publication Data

US 2018/0325272 A1 Nov. 15, 2018

Related U.S. Application Data

(60) Provisional application No. 62/506,194, filed on May 15, 2017.

(51) Int. Cl.

| | |
|---|---|
| ***A47C 21/00*** | (2006.01) |
| ***A63B 21/00*** | (2006.01) |
| ***A47G 9/00*** | (2006.01) |

(52) U.S. Cl.

CPC ..... *A47C 21/00* (2013.01); *A47G 9/00* (2013.01); *A63B 21/00047* (2013.01); *A63B 21/4037* (2015.10)

(58) Field of Classification Search

CPC ..... A47C 21/00; A47C 21/022; A47C 31/08; A63B 21/00047; A63B 21/4037; A63B 2210/04; A63B 21/1672; A63B 21/4029; A47G 9/00; A61G 7/103; A61G 7/1026; Y10S 5/922; Y10S 5/923; Y10S 16/28

See application file for complete search history.

(56) References Cited

U.S. PATENT DOCUMENTS

| | | | | |
|---|---|---|---|---|
| 1,328,621 A * | 1/1920 | Dennison | ..... | A47C 21/022 24/72.5 |
| 2,155,690 A * | 4/1939 | Simpson | ..... | A47C 21/022 5/498 |
| 2,448,162 A | 8/1948 | Wettlaufer | | |
| 4,136,868 A * | 1/1979 | Hogue | ..... | A63B 21/00047 482/145 |
| 4,609,192 A | 9/1986 | Bratcher | | |
| 5,114,387 A * | 5/1992 | Keppler | ..... | A63B 21/4037 434/253 |

(Continued)

FOREIGN PATENT DOCUMENTS

WO WO-8607253 A1 * 12/1986 ..... A47C 21/026

*Primary Examiner* — Robert G Santos
*Assistant Examiner* — Alison N Labarge
(74) *Attorney, Agent, or Firm* — Boudwin Intellectual Property; Daniel Boudwin

(57) ABSTRACT

A bed-mounted exercise system. The bed-mounted exercise system includes a platform removably securable to a bed via a plurality of straps and an exercise pad removably securable to the platform. The pad includes a lower surface including a plurality of attachment fasteners thereon. The platform includes an upper surface including a plurality of mating fasteners thereon. The pad is removably securable to the platform via engagement of the plurality of attachment fasteners with the plurality of mating fasteners. A plurality of strap apertures disposed on the platform are configured to receive either a first end or a second end of one of the plurality of straps therethrough. The platform can be positioned atop a mattress and secured to a bed frame thereunder via fasteners disposed on the plurality of straps. The pad can then be fastened to the platform, providing a comfortable yet stable surface on which to perform exercises.

1 Claim, 2 Drawing Sheets

(56) References Cited

U.S. PATENT DOCUMENTS

| | | | | |
|---|---|---|---|---|
| 5,375,280 | A | 12/1994 | O'Sullivan et al. | |
| 5,417,636 | A * | 5/1995 | Havens | A63B 21/0552 482/140 |
| 5,795,276 | A | 8/1998 | Almeda | |
| 7,520,846 | B1 * | 4/2009 | Manuel | A63B 6/00 482/142 |
| 8,032,959 | B2 * | 10/2011 | Rowson | A47G 9/02 5/488 |
| 8,365,326 | B2 * | 2/2013 | Kenalty | A61G 1/00 5/625 |
| 2005/0055768 | A1 * | 3/2005 | Assink | A61G 1/01 5/81.1 R |
| 2005/0060808 | A1 * | 3/2005 | Shaw | A47C 20/021 5/649 |
| 2015/0238820 | A1 * | 8/2015 | Langer | B32B 7/08 482/142 |

* cited by examiner

BED MOUNTED EXERCISE SYSTEM

CROSS REFERENCE TO RELATED APPLICATIONS

This application claims the benefit of U.S. Provisional Application No. 62/506,194 filed on May 15, 2017. The above identified patent application is herein incorporated by reference in its entirety to provide continuity of disclosure.

FIELD OF THE INVENTION

The present invention relates to exercise systems. More specifically, the present invention provides an exercise system that is securable to a bed for providing a comfortable and stable exercise surface positioned atop a mattress.

BACKGROUND OF THE INVENTION

Many individuals perform exercises in order to maintain or build strength and mobility. It is particularly important for individuals recovering from surgery or other medical procedures to exercise in order to make a full recovery. For these and other individuals, it can be difficult to utilize traditional exercise equipment. Further, it may be difficult for these individuals to leave their surroundings to attend a gym or other location where exercises can be conducted. Some individuals choose to perform exercises in their bed atop their mattress. However, it can be difficult to maintain proper balance and form when standing, kneeling, or otherwise being supported on an unstable mattress surface. An individual may lose their balance and fall from the unsteady mattress surface. Some individuals may place a yoga mat or other exercise mat on the bed to improve stability. However, the mat can easily slip and fall from the bed, potentially causing injury. In view of the above concerns, it is desirable to provide a bed-mounted exercise system that is removably securable to a mattress and provides a stable yet comfortable surface on which an individual may perform various exercises.

In light of the devices disclosed in the prior art, it is submitted that the present invention substantially diverges in design elements from the known art and consequently it is clear that there is a need in the art for an improvement to existing exercise systems. In this regard the present invention substantially fulfills these needs.

SUMMARY OF THE INVENTION

In view of the foregoing disadvantages inherent in the known types of exercise systems now present in the prior art, the present invention provides a bed-mounted exercise system wherein the same can be utilized for providing convenience for the user when utilizing a comfortable yet stable surface upon which exercises may be performed. The bed-mounted exercise system includes a platform removably securable to a bed via a plurality of straps and an exercise pad removably securable to the platform. The pad includes a first perimeter, an upper surface, and a lower surface, the lower surface including a plurality of attachment fasteners thereon. A platform includes a second perimeter, an upper surface, and a lower surface, the lower surface including a plurality of mating fasteners thereon. The pad is removably securable to the platform via engagement of the plurality of attachment fasteners with the plurality of mating fasteners. A plurality of strap apertures are disposed on the platform. The exercise system further includes a plurality of straps, each strap including a first fastener disposed on a first end thereof and a second fastener disposed on a second end thereof, wherein the first fastener is configured to be removably securable to the second fastener. Each strap aperture is configured to receive either the first end or the second end of one of the plurality of straps therethrough. The platform can be positioned atop a mattress and secured to a bed frame thereunder via the plurality of straps, and the pad can then be fastened to the platform, providing a comfortable yet stable surface on which to perform exercises.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
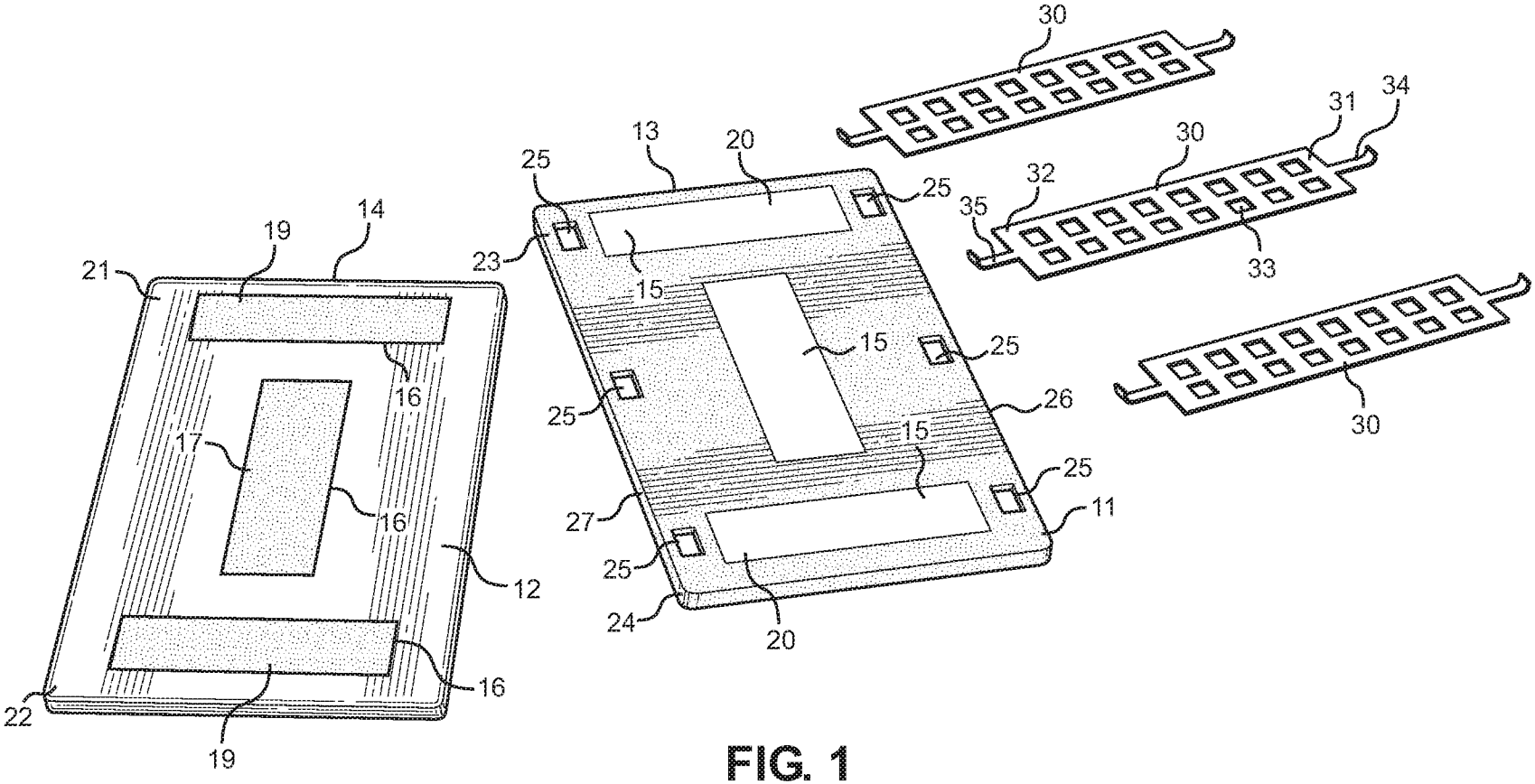
FIG. 1 shows a perspective view of the components of the bed-mounted exercise system.

Reference is made herein to the attached drawings. Like reference numerals are used throughout the drawings to depict like or similar elements of the bed-mounted exercise platform. For the purposes of presenting a brief and clear description of the present invention, the preferred embodiment will be discussed as used for providing a stable platform for performing exercises on top of a bed. The figures are intended for representative purposes only and should not be considered to be limiting in any respect.

Referring now to FIG. 1, there is shown a perspective view of the components of the bed-mounted exercise system. The bed-mounted exercise system generally includes a platform 11 configured to be placed on top of a bed, a pad 12 configured to be removably secured to the platform 11, and a plurality of straps 30 configured to secure the platform 11 to the bed. The platform 11 includes an upper side 28, a lower side 29, and a generally rectangular perimeter edge 13. The platform 11 is preferably composed from a rigid material in order to provide a sturdy base for the pad 12. The pad 12 is preferably composed from a flexible and cushioned material so that it provides a comfortable support surface for the user. The pad 12 includes an upper side, a lower side, and a generally rectangular perimeter edge 14.

The platform 11 and pad 12 include corresponding fasteners configured to allow for removable securement. The platform 11 includes a plurality of fasteners 15 while the pad includes a plurality of mating fasteners 16 configured to removably secure to the fasteners of the platform 15. The fasteners 15 and mating fasteners 16 may include hook and loop material, adhesive material, or any other suitable fastener configured to provide removable coupling between two members. In the shown embodiment, the pad 12 includes a first attachment fastener disposed on a first end 21 thereof, a second attachment fastener disposed on a second end 22 thereof, and a third attachment fastener 17 disposed between the first and second attachment fasteners. The third attachment fastener 17 is oriented perpendicular to the first attachment fastener and the second attachment fastener. This particular arrangement provides multiple connection points with a large surface area in order to effectively secure the pad 12 to the platform.

In one embodiment, the perimeter 14 of the pad 12 is equal to the perimeter 13 of the platform 11. The equal perimeters allow the pad 12 and the platform 11 to be aligned with one another in a stacked configuration during use. In the shown embodiment, when the pad 12 is positioned over the platform 11, the fasteners 15 of the pad 12 align with the mating fasteners 16 of the platform 11, and the perimeter edge 14 of the pad 12 aligns with the perimeter edge 13 of the platform 11. This provides a stable connection between the two components and provides an overall stable and safe support surface for an individual.

In the shown embodiment, the platform 11 further includes a plurality of strap apertures 25 each configured to receive a portion of a strap 30 therethrough. The straps 30 are configured to wrap around over the upper surface of the platform 11 and under a mattress, such that the platform 11 is effectively secured to the bed. In some embodiments, there are no strap apertures 25 and the strap 30 simply wraps around the upper surface of the platform 11. In the shown embodiment, the strap apertures 25 are disposed about the perimeter 13 of the platform 11 equidistant from one another, allowing the retaining force of the straps 30 to be spread across the surface area of the platform 11. Each strap 30 includes a first fastener 34 disposed on a first end 31 thereof and a corresponding second fastener 35 disposed on an opposing second end 32 thereof. The strap fasteners 34, 35 can include hook and loop material or any other suitable fastener.

In the shown embodiment, each strap 30 includes a plurality of openings 33 arranged in a grid pattern. The strap 30 includes elastic material so that it can stretch to fit any size mattress or bed. The grid pattern allows for even distribution of force as the strap 30 stretches. In the shown embodiment, the grid pattern includes a first row of openings disposed on a first side of each strap 30 and a second row of openings disposed on a second side of each strap 30. However, alternate embodiments can include a strap 30 that is a solid piece of material with no openings, or can include openings arranged in a grid having a different number of rows.

Figure 2:
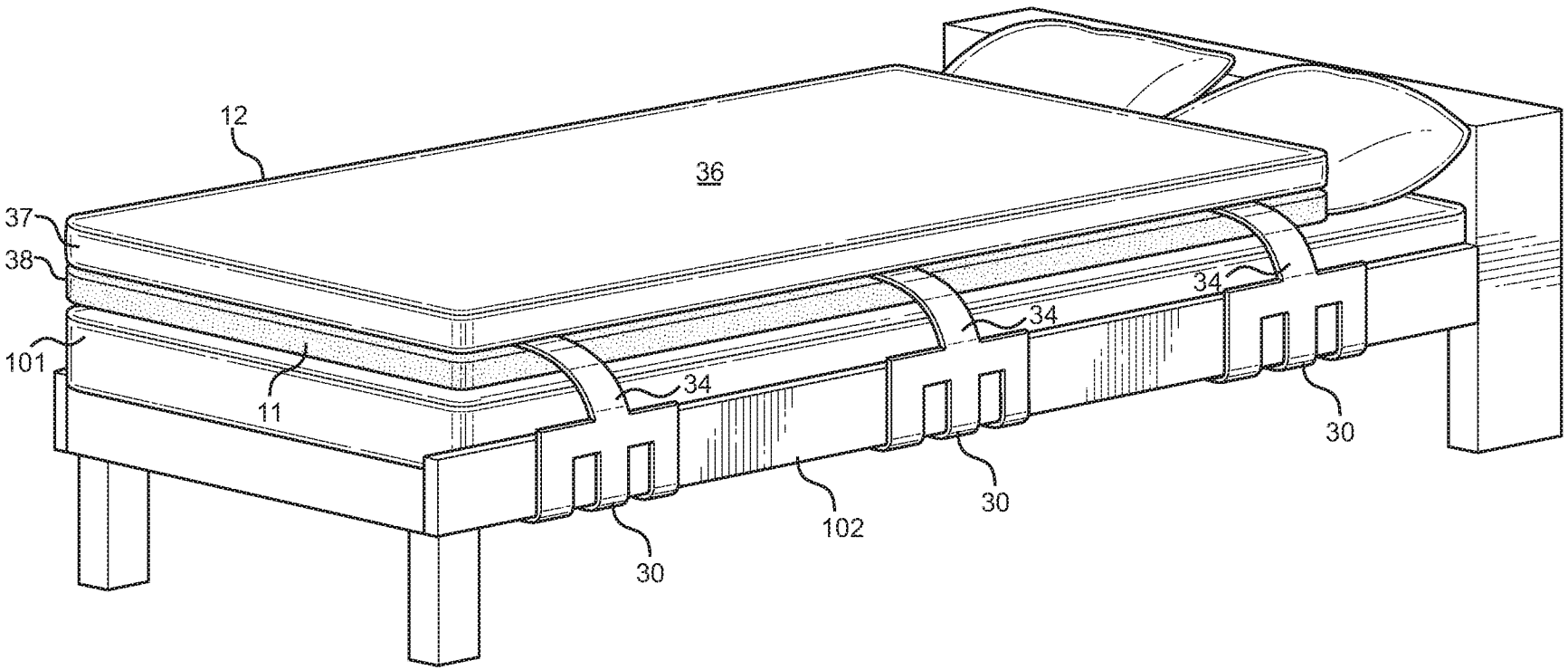
FIG. 2 shows a perspective view of the bed-mounted exercise system secured to a bed.

Referring now to FIG. 2, there is shown a perspective view of the bed-mounted exercise system secured to a bed. In operation, a user places the platform 11 on top of a mattress 101. The user then secures the platform 11 to the mattress 101 via the straps 30, such that a portion of the straps 30 wrap underneath the bedframe or box-spring 102. The user then fastens the pad 12 to the platform 11 such that an outer edge 37 of the pad 12 and an outer edge 38 of the platform 11 are aligned. The user may then position themselves on the upper surface 36 of the pad 12, and the pad 12 can then be utilized to perform various exercises. Since the pad 12 is fastened to the platform 11 and the platform 11 is fastened to the bed, the system will not be moved out of position while it is in use. In this way, the system can be secured to a bed to provide a comfortable yet stable platform for performing various exercises.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise system, consisting of:

a pad including a first perimeter, a pad upper surface, and a pad lower surface, the pad lower surface including a plurality of attachment fasteners thereon;

a platform composed of a rigid material, including a second perimeter, a platform upper surface, and a platform lower surface, the platform upper surface including a plurality of mating fasteners thereon, the pad being removably securable to the platform via engagement of the plurality of attachment fasteners with the plurality of mating fasteners;

a plurality of strap apertures disposed on the platform;

a plurality of straps, each strap including a first fastener disposed on a first end thereof and a second fastener disposed on a second end thereof, wherein the first fastener is configured to be removably securable to the second fastener;

wherein each strap aperture is configured to receive either the first end or the second end of one of the plurality of straps therethrough.

* * * * *